United States Patent [19]

Johnson

[11] 4,063,499

[45] Dec. 20, 1977

[54] CAM FEED WITH CYCLE SYNCHRONIZATION

[75] Inventor: Kenneth C. Johnson, Des Plaines, Ill.

[73] Assignee: F. J. Littell Machine Company, Chicago, Ill.

[21] Appl. No.: 752,206

[22] Filed: Dec. 20, 1976

[51] Int. Cl.[2] ..... B30B 15/30; B65H 17/22

[52] U.S. Cl. ..... 100/215; 72/421; 226/156

[58] Field of Search ..... 100/215; 72/404, 405, 72/421; 83/273, 436; 226/156

[56] References Cited

U.S. PATENT DOCUMENTS

| | | | |
|---|---|---|---|
| 2,582,106 | 1/1952 | Crowley et al. | 83/436 X |
| 3,456,859 | 7/1969 | Beifuss | 226/156 X |
| 3,613,565 | 10/1971 | Muller | 100/215 |
| 3,638,846 | 2/1972 | Wiig | 226/156 X |
| 3,754,705 | 8/1973 | Wiig | 226/156 X |

*Primary Examiner*—Philip R. Coe
*Attorney, Agent, or Firm*—Russell H. Clark

[57] ABSTRACT

A gear and cam housing journals the shaft for intermittently driving the lower feed roll by means of conjugate cams, and by adjusting the vertical position of the housing, the feed line height is likewise adjusted. The invention provides a timing belt drive from the main drive shaft for the press to the drive shaft for the conjugate cams which will permit adjustments for feed line height while maintaining synchronized feed cycle and press timing relationship. Specifically, the apparatus includes a pair of sprockets and timing belts arranged to form an elbow, with one belt operatively connecting the press drive shaft with one timing sprocket at the elbow and wherein the other timing belt operatively connects the other timing sprocket with the drive shaft for the conjugate cams.

10 Claims, 8 Drawing Figures

71
13
63
62
4
5
87
88
47
64
90
91
6
96
48
65
68
89
35
40
95
100
41
104
97
98
51
42
52

95
102
103
96
98
97
48
104
105
48
50
51
47
50
101
100

13
84
85
86
93
92
87
91
90
88
47
74
75
63
68
89
79
70
80
77
35
36
66
65
64
67
76
78
71
82
81
72
83
74
63
62

CAM FEED WITH CYCLE SYNCHRONIZATION

The invention relates generally to strip feeding means for feeding strip material which is unwinding from a coil to a press for cutting, punching or forming operations and has more particular reference to a timing belt drive from the press to the lower feed roll cam drive shaft which will permit adjustments for feed line height while maintaining feed cycle synchronization with the press.

A variety of strip feeding machines are presently in use for feeding strip material such as metal or plastic to a press for operations thereon and all such machines have one piece of equipment in common, namely a pair of feed rolls with the strip material passing between the rolls. One of said rolls is driven and the other roll generally the upper thus functions as an idler roll which however is pressure energized towards the driven roll to form the bite on the strip material to thus cause it to feed forwardly into the press and between the lower stationary die and the upper movable die. Whereas the press drive shaft is driven continuously, the lower feed roll is rotated intermittently for obtaining various feed lengths. Said feed lengths will vary depending on the diameter of the lower feed roll and the extent of its intermittent rotations.

In my patent No. 4,024,774 granted May 24, 1977 and entitled Modular Cam Driven Roll Feed, the driven roll of the feeding couple is intermittently rotated by conjugate cams for advancing the material to the press and the gear and cam housing is releasably attached to the rear wall of the press by means of a bracket that can be secured to the rear in a desired vertical position. The gear and cam housing journals the shaft for intermittently driving the lower feed roll by means of the conjugate cams and thus by adjusting the vertical position of the housing the feed line height is likewise adjusted.

This vertical adjustment is necessary in order to horizontally position the feed line height with respect to the die in the press. A certain feed line height applies to each particular die. However the thickness of the stationary dies used in a press will vary and thus the feed line height for various dies will be different. Also the lower driven feed roll may be removed and replaced by a larger or smaller diameter roll, and this will also cause a change in the feed line height. Any change in feed line height requires a change in the vertical position of the gear and cam housing which in turn changes the driving characteristics between the press drive shaft and the main drive shaft for the conjugate cams.

The intermittent rotary movement of the lower feed roll must be precisely synchronized with the vertical reciprocations of the movable die in the press and a change in the vertical position of the gear and cam housing will seriously affect this precisely synchronized intermittent rotations of the lower feed roll. Accordingly the invention has for its main objective to provide a timing belt drive from the press drive shaft to the main drive shaft for the conjugate cams which will permit adjustments for feed line height while maintaining synchronized feed cycle and press timing relationship.

Another and more specific object resides in the provision of a novel and improved arrangement of timing belts designed to pass over timing sprockets to prevent slippage and wherein an elbow is provided in the drive and which is characterized by a pair of timing sprockets journalled for rotation by the same shaft.

Another object of the invention is to provide a timing belt drive that will include a pair of timing belts with one belt operatively connecting the press drive shaft with a timing sprocket at the elbow and wherein the other timing belt operatively connects the said timing sprocket with the main drive shaft for the conjugate cams.

A further object is to provide a timing belt arrangement for operatively connecting the press drive shaft with the cam driven shaft for the lower feed roll, the cam driven shaft being journalled by a gear and cam housing which is releasably secured in a vertically adjustable manner to the rear wall of the press and wherein the timing belt arrangement includes an elbow so that vertical adjustments of the gear and cam housing can be made to obtain the desired feed line height while maintaining feed cycle synchronization with the press.

With these and other objects in view, the invention may consist of certain novel features of construction and operation as will be more fully described and particularly pointed out in the specification, drawings and claims.

In the drawings which illustrate an embodiment of the invention and wherein like reference characters are used to indicate like parts;

Figure 1:
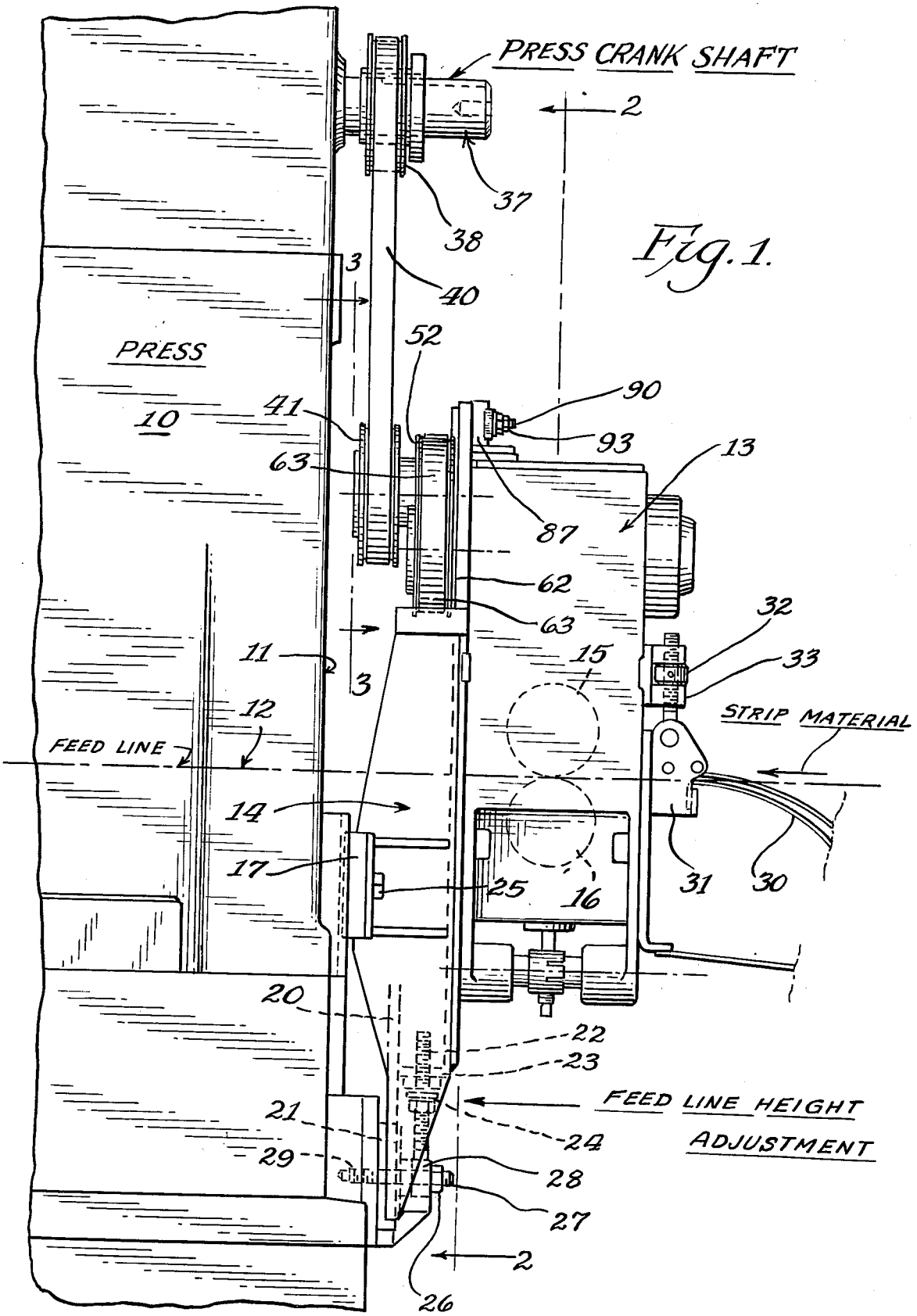
FIG. 1 is a side elevational view showing a press having a cam and gear housing in supported relation on its rear wall and illustrating the flexible timing belt drive of the invention which operatively connects the press drive shaft with the input shaft for the lower feed roll, the latter shaft being journalled by the cam and gear housing.
Figure 2:
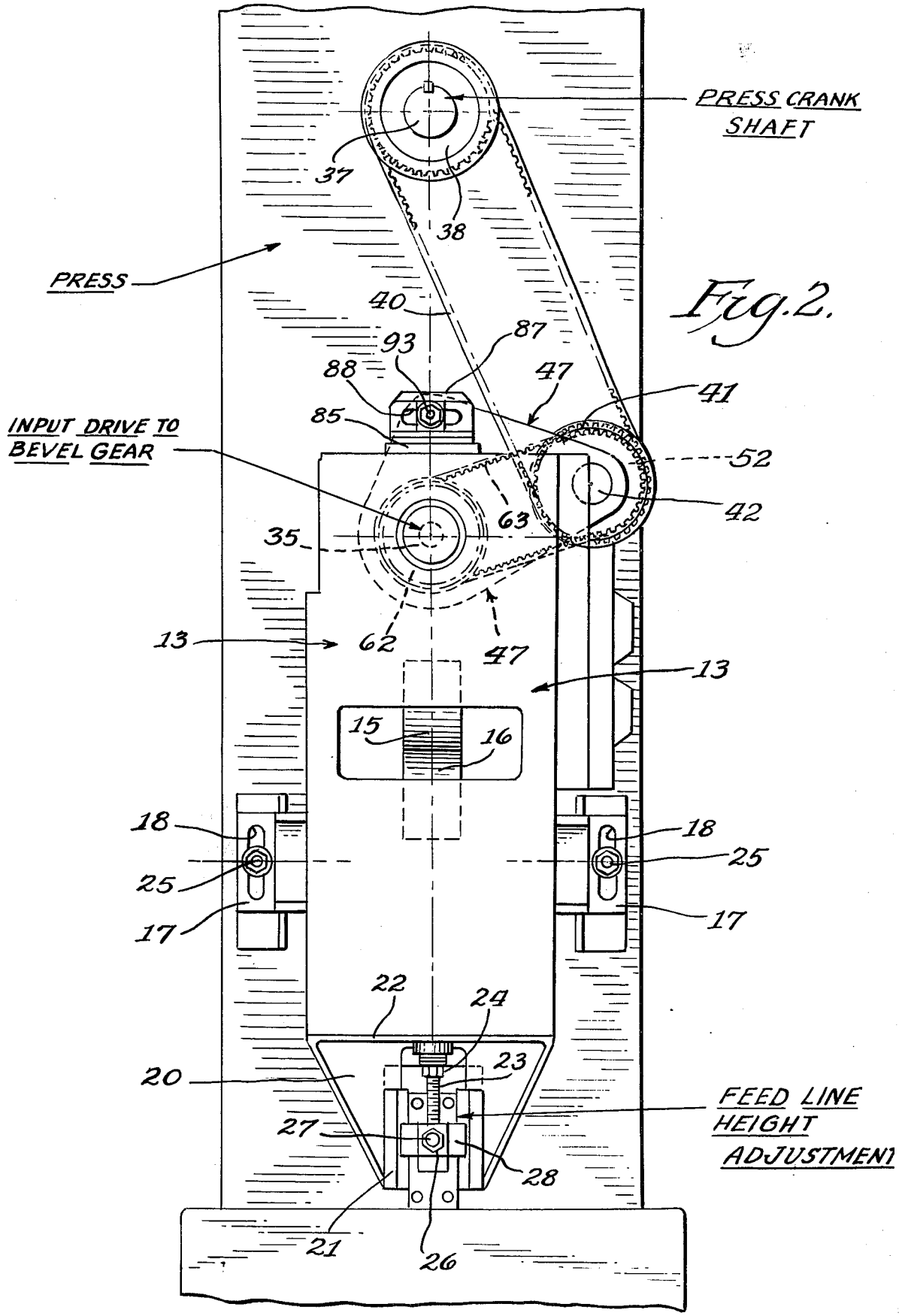
FIG. 2 is a rear elevational view taken substantially on line 2—2 of FIG. 1 and showing the cam and gear housing and the timing belt drive of the invention.
Figure 3:
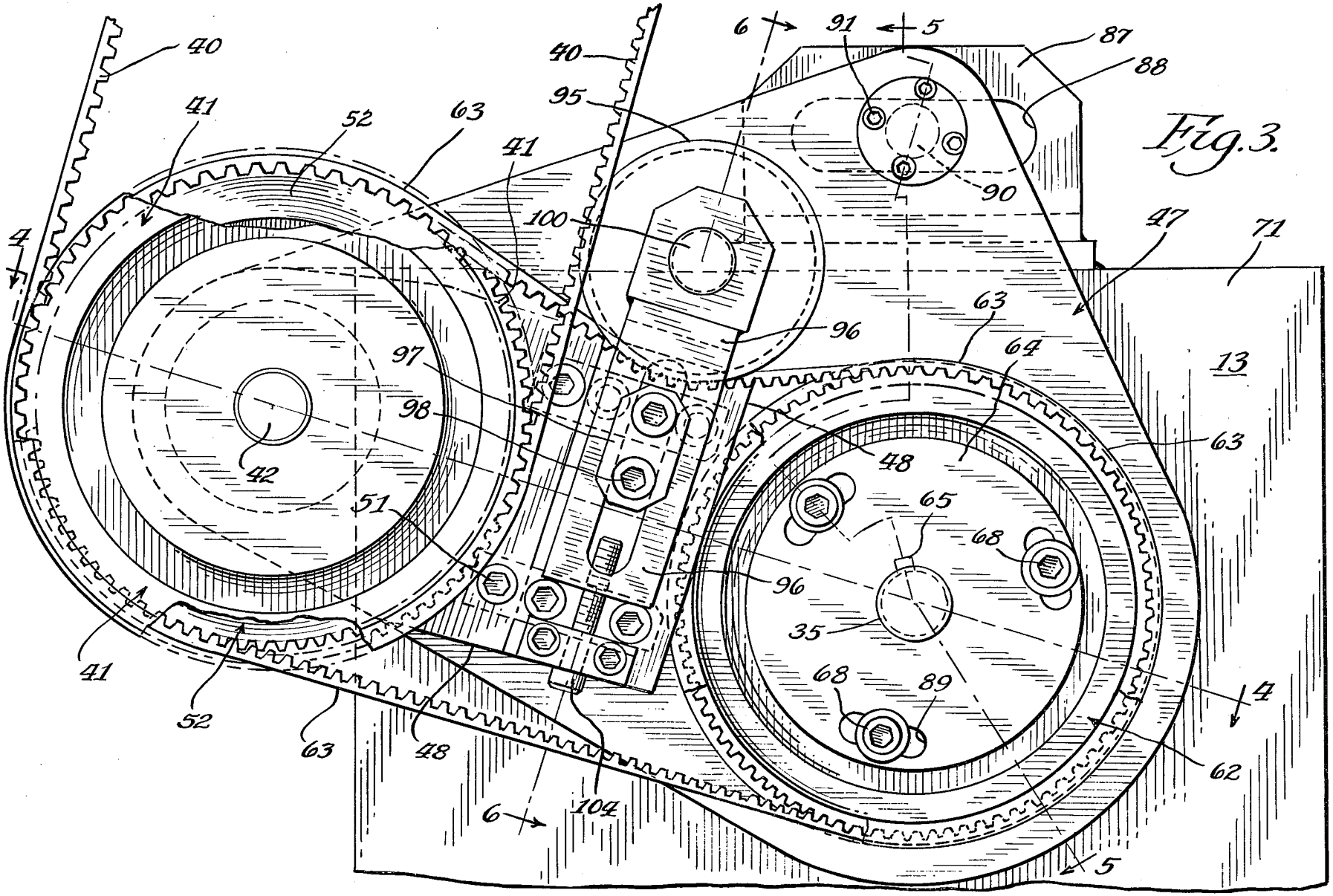
FIG. 3 is a view mostly in elevation taken substantially on line 3—3 of FIG. 1 and showing on a larger scale the two timing belts, the swing plate and the arrangement of the several timing sprockets forming the elbow of the present drive.

The press shown in FIGS. 1 and 2 and identified by numeral 10, is adapted to receive strip material which is fed to the press through an elongated horizontal slot in the back wall 11 of the press and the feed line height is indicated in FIG. 1 by numeral 12. The cam and gear housing 13 is suitably fixed to a press adapter bracket 14 and this bracket is in turn fixed to the rear wall of the press in a precise position vertically so that the feed rolls 15 and 16 within the housing 13 have an exact position for the particular feed line height. Since the gear and cam housing is carried by the press adapter bracker 14 any vertical adjustment of the housing must be made by adjusting the position of the bracket on the rear wall of the press and accordingly the bracket is provided with side extensions 17 having elongated slots 18 best shown in FIG. 2, with the base of the bracket having depending extension 20 formed with the vertical gibs 21. The bottom wall 22 of the bracket receives the threaded bolt 23 which is locked in adjusted position by the nut 24. This determines the vertical position of the gear and cam housing on the rear wall of the press. The bolts 25 which pass through the slots 18 and into the said rear wall can now be tightened and the same action is given to the nut 26 on bolt 27. Said bolt passes through the clamp 28 and is threaded into the press wall at 29. By tightening the nut 26, the clamp is held to the gibs 21 and since bolt 23 rests on and is supported by the clamp 28, the depending extension and the bracket including the supported gear and cam housing all as a unit are releasably fixed to the press wall in the desired vertical position as regards feed line height.

The entrance apron 30 for the strip material is shown in FIG. 1 as applied to the rear wall of the cam and gear housing 13 and the attaching fixture 31 is adjustable in a vertical direction by the bolt and nut arrangement 32 which co-acts with the member 33 having a fixed securement to the housing. The input drive shaft 35, FIGS. 2 and 5, journalled in a manner to be presently described, is provided with a bevel gear 36, and as described and claimed in my co-pending application Ser. No. 655,440, previously referred to, the input drive shaft through said bevel gear drives the conjugate cams and accordingly the lower feed roll 16 is driven in an intermittent manner. As well known in the art, the intermittent rotations of the lower feed roll are precisely correlated with the vertical reciprocating movements of the upper die in the press. This requires a drive from the press to the input drive shaft and the new and novel flexible belt drive of the invention is shown in FIGS. 1,2,7 and 8. The remaining figures show constructional details of the drive.

As shown in FIG. 2, the press drive shaft 37, sometimes called the press crank shaft, has the timing sprocket 38 suitably mounted thereon and keyed thereto so that the timing sprocket always rotates with the shaft. The timing belt 40 passes around the top arcuate portion of the sprocket 38 and said belt and sprocket have teeth formed on the same for interaction to prevent slippage between the parts, FIGS. 7 and 8. The belt 40 extends downwardly to pass around a second timing sprocket 41 mounted on and keyed to the cantilevered end of shaft 42, FIG. 4, so as to cause its journalling shaft to rotate. Since the sprockets 38 and 41, FIG. 1, have the same effective diameter, the shaft 42 will rotate at the same speed as the press crank shaft 37, that is the ratio is one to one.

The second timing sprocket 41 is keyed to shaft 42 by means of the hub portion 43 which is keyed at 44 to said shaft and said hub portion is tapered at 45 for a tight and secure fit with the complementary tapered inside surface 46 provided by the timing sprocket 41. Said sprocket and its journalling shaft are part of the elbow of the present belt drive which also includes the swing-plate 47 and the journalling plate 48 secured to said swing plate by the spacing element 50 and the securing bolts 51. The elbow is completed by the third timing sprocket 52 also keyed as at 53 to shaft 42. Timing sprocket 52 fixed to shaft 42 is journalled for rotation on the swing plate 47 by a ball bearing unit including an outer race 54 secured in the swing plate, an inner race 55 secured on the shaft and by the balls 56 confined in operative relation between the races. On the other side of the third timing sprocket 52, the shaft 42 is suitably journalled by a second ball bearing unit including an outer race 57 mounted on the plate 48, an inner race 58 mounted on the shaft and by the balls 60 confined in operative relation between the races. The shaft is accordingly journalled for rotation at spaced locations and the drive to sprocket 41 is transmitted by shaft 42 to the sprocket 52.

Figure 4:
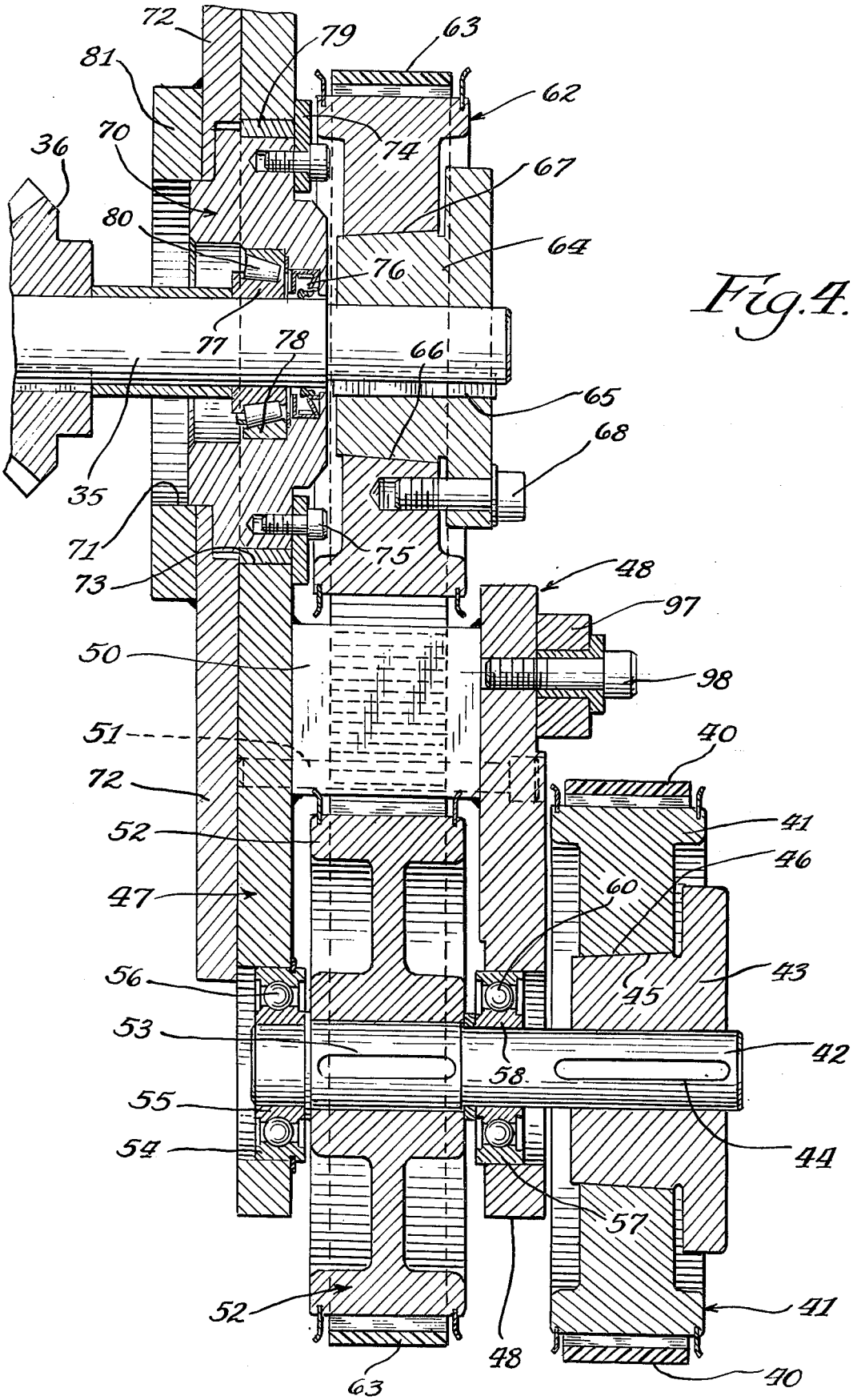
FIG. 4 is a sectional view taken substantially on line 4—4 of FIG. 3.
Figure 8:
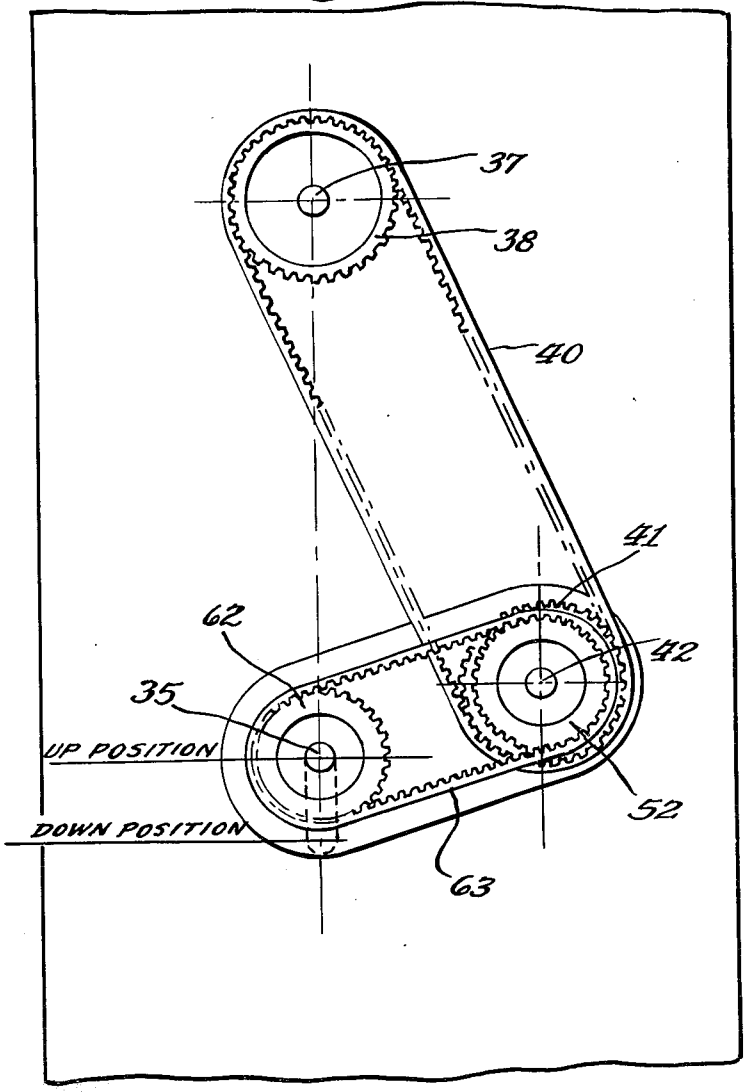
FIGS. 7 and 8 are elevational views which illustrate the timing belts and elbow arrangement of the present belt drive which provides for vertical adjusting movement of the input drive shaft for the lower feed roll.
Figure 7:
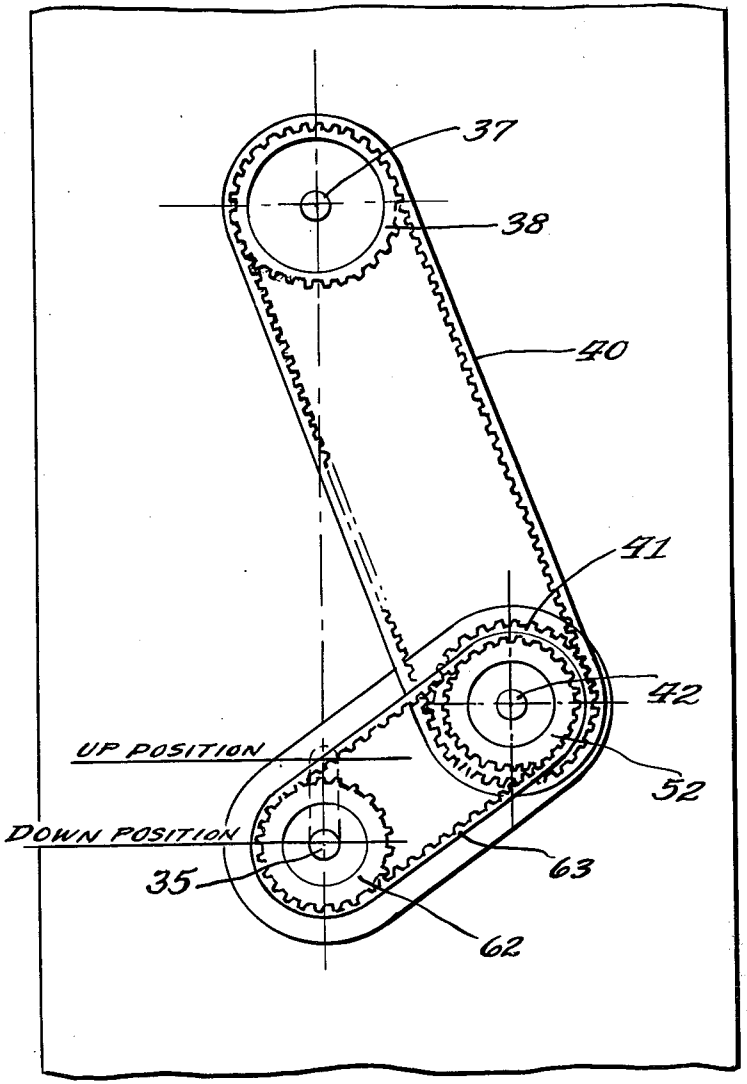

The flexible belt drive of the invention is continued from the press crank shaft and from the third sprocket 42 to the input drive shaft 35 by the fourth timing sprocket 62 and by the timing belt 63 as clearly shown in FIGS. 4,7 and 8. The sprocket 62 is keyed to shaft 35 in a rotative adjustable manner by the hub portion 64 which is directly keyed to shaft 35 at 65 and has a sloping or tapered surface 66 which co-acts to provide a tight fit with a complementary tapering surface 67 provided by the sprocket 62. After the desired rotative adjustment of the sprocket on the hub portion has been obtained, then the parts are secured together by the securing bolts 68 which pass through arcuate openings in the hub portion for threaded securement in the sprocket. As previously stated, the shaft 35 has the bevel gear 36 fixed thereto and the shaft extends from the sprocket 62 through journalling means retained and mounted in the hub portion 70 which has interfitting relation in opening 71 in the wall 72 of the gear and cam housing 13. The bevel gear 36 is thus located within the housing for meshing relation with another bevel gear for driving the lower roll 16.

The hub portion 70 is located within an opening 73 in the swing plate 47 which is larger in diameter than the hub portion to provide an annular space for the ring bushing 79. Said bushing is retained in place by the retaining washer 74, the same overlapping the swing plate and being secured to the hub portion by the bolts 75. An oil ring 76 is located adjacent the bearing unit having the inner and outer races 77 and 78 and the tapered bearings 80. The hub portion 70 is secured to the housing wall 72 and the reinforcing wall 81 by the bolts 82 shown in FIG. 5. The shaft 35 and also the hub portion 70 and the ring bushing 79 thus provide the center for the limited rotative adjustments of the swing plate. Said plate can be rotated for adjustment on the ring bushing 79 and around the input shaft 35 as an axis. The hub portion has a close interfitting relation in opening 71 in the front wall of the housing 13 and likewise in a similar aligned opening in the reinforcing wall 81 secured to the inside of the housing's front wall. The oil tube 83 is provided for lubricating the bushing ring 79. It is neccessary at times to adjust the swing plate and accordingly the parts such as the swing plate, the hub portion and the ring bushing are maintained lubricated so that at any time the swing plate can be rotatively adjusted to a position to accord with the proper feed line height. The supporting means for the swing plate on the cam and gear housing will now be described.

Figure 5:
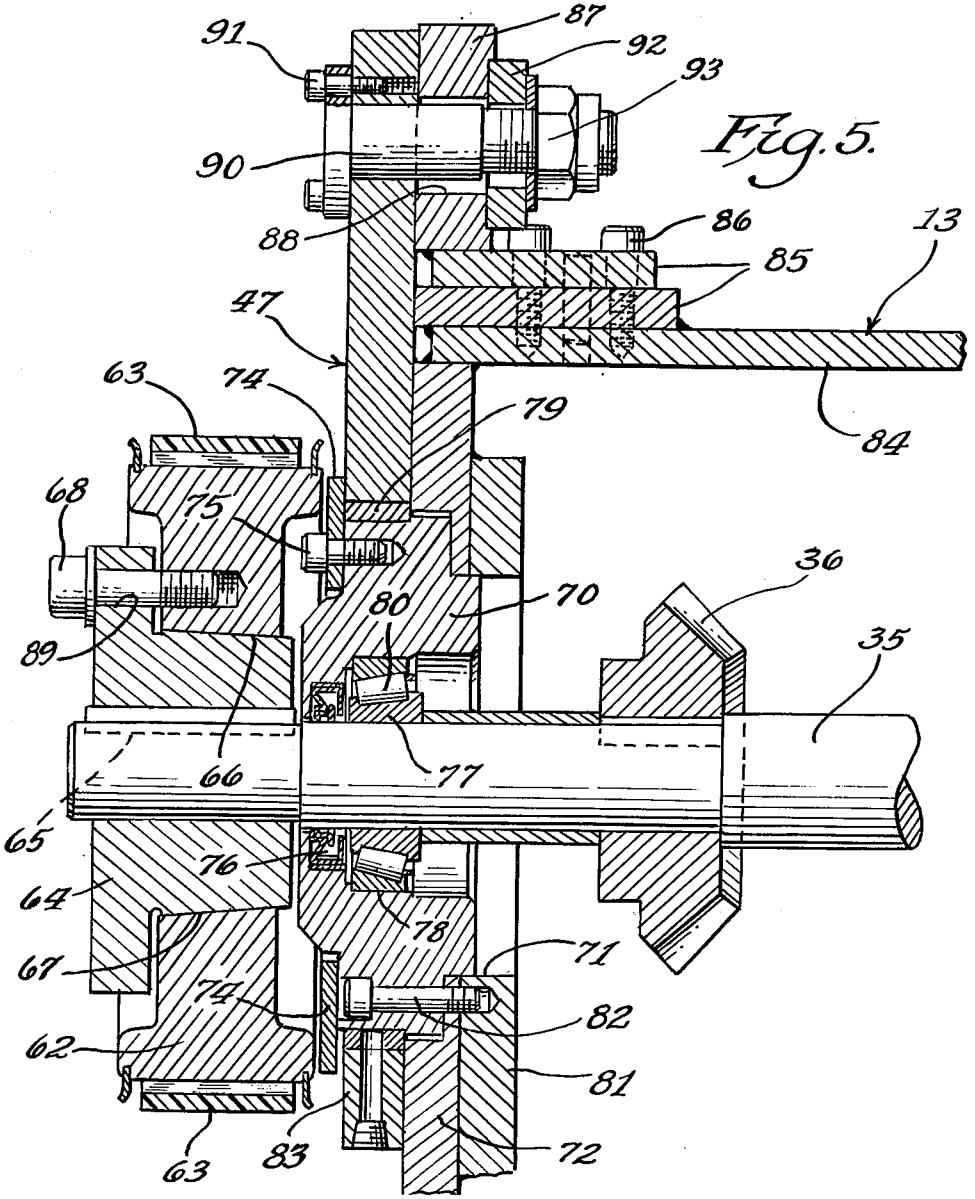
FIG. 5 is a sectional view taken substantially on line 5—5 of FIG. 3.

The said housing has a top wall identified by numeral 84 FIG. 5, suitably joined and connected as by welding to the front wall 71 and which is reinforced at its connection to the front wall by a pair of reinforcing plates or discs 85, being welded in place and also secured to the top wall by the bolts 86. The base clamp element 87 is also part of the plate-like reinforcing means and said base clamp element is formed with a horizontal elongated opening 88 through which the clamping bolt 90 extends. Said bolt is secured by the bolts 91 to the front side of the swing plate 47 and the bolt 90 thus projects through the opening 88 to receive the base clamp element 87, the clamp 92 and the securing nut 93. By tightening the nut 93 on the bolt 90, the clamp is forced into contact with the base clamp element 87 which in turn is caused to contact the swing plate. Since the bolt 90 has its base secured to the swing plate, the tightening action will secure the swing plate to the cam and gear housing. Of course the secured position of the swing plate as regards the housing can be changed since the bolt 90 passes through the elongated opening 88.

Figure 6:
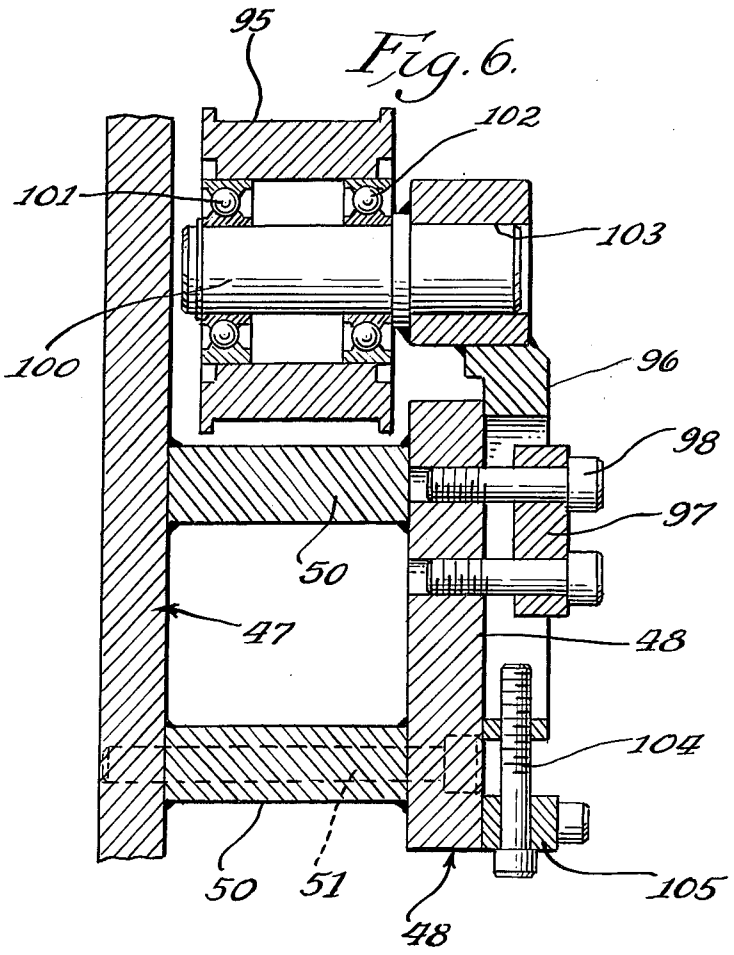
FIG. 6 is a sectional view taken substantially on line 6—6 of FIG. 3.

Flexible timing belts have a tendency to elongate with use and also a replacement belt may not have exactly the same length as the belt it replaces. Thus undesirable slack develops and means must be provided to take up such slack, whenever it occurs. The timing belt 40 is not involved since any slack in the belt can be taken up at the elbow by a minor adjustment of the swing plate 47. Should the belt 40 develop slack and become loose, then the swing plate can be adjustably rotated clockwise around the input shaft 35 as an axis and the timing sprocket 41 will be adjusted downwardly to tighten said belt. However the timing belt 63 cannot be tightened except by means of an idler roller since the spaced shafts 42 and 35 are fixed in spaced relation. The invention thus provides an idler roller designated by numeral 95, FIGS. 5 and 6, and an idler roller support 96 which is adjustably secured by the clamp 97 and by the bolts 98 to the journalling plate 48. The idler roller 95 has contact with the outside surface of the belt 63 and as shown in FIG. 6 the roller is mounted for rotation on the stud shaft 100 by means of the ball bearing units 101 and 102. The stud shaft is suitably fixed to the idler roller support 96 by welding and by having a tight fit in opening 103 formed in the upper extending portion of the said roller support. Up and down adjustment of the roller support is provided for by the threaded adjusting screw 104 which passes through the part 105 of the journalling plate to have threaded relation with the base of the idler roller support.

In operative use of the present belt drive, the input drive shaft 35 can be adjusted vertically to achieve the precise feed line height and the synchronization of the feed cycle with respect to the movable die in the press is maintained. As stated, the speed ratio between the press crank shaft 37 and the second timing sprocket 41 is one to one. The same speed ratio exists between the third timing sprocket 52 and the forth timing sprocket 62. Thus the input drive shaft is driven at the same speed as the press crank shaft. This speed ratio is not limited to one to one since other sprocket ratios may be required depending on the bevel gear ratio and the conjugate cam design. For adjustment purposes it is of course necessary to loosen the swing plate clamp 87 and then the weight of the swing plate and the timing sprockets at the elbow will maintain desirable tension on the timing belt 40. Thus the operator has freedom for adjusting the gear and cam housing in either an up or a down position. For fine adjustments that is within one sprocket tooth pitch, the arcuate slots 89 in hub portion 64 can be employed. These slots receive the bolts 68 which releasably lock the keyed hub portion to the forth sprocket. FIG. 7 shows the input drive shaft 35 located in its maximum down position and FIG. 8 illustrates the action of the elbow arrangement of the present drive in permitting the input drive shaft to be located in its maximum up position.

What is claimed is:

1. In a flexible belt drive for an intermittently driven feed roll, the combination with a press adapted to operate on strip material and having a press drive shaft, a gear and cam housing providing an input drive shaft for driving the said feed roll and having an adjustably fixed position on the press, a swing plate rotatably mounted on the input drive shaft for rotative adjustments, said swing plate having a releasably fixed connection to the gear and cam housing for any rotatably adjusted position of the plate, a stud shaft supported by the swing plate and being journalled thereby for rotation, a pair of timing sprockets keyed to the shaft in side by side relation so as to rotate with the shaft, a first timing belt operatively connecting the press drive shaft with one of said timing sprockets, and a second timing belt operatively connecting the timing sprocket with the input drive shaft.

2. A flexible belt drive for an intermittently driven feed roll as defined by claim 1, additionally including a third timing sprocket in fixed relation on the press drive shaft and having operative contact with the first timing belt, and a fourth timing sprocket in fixed relation on the input drive shaft and having operative contact with the second timing belt.

3. A flexible belt drive for an intermittently driven feed roll as defined by claim 1, wherein the gear and cam housing is vertically adjustable on the press for obtaining the desired feed line height, and additionally including a bearing unit for journalling the input drive shaft in a wall of the gear and cam housing, a third timing sprocket in fixed relation on the press drive shaft and having operative contact with the first timing belt and a fourth timing sprocket in fixed relation on the input drive shaft and having operative contact with the second timing belt.

4. A flexible belt drive for an intermittently driven feed roll as defined by claim 1, wherein the gear and cam housing is vertically adjustable on the press for obtaining the desired feed line height, wherein a bearing unit is provided in fixed position in a wall of the gear and cam housing for journalling the input dirve shaft for rotation, wherein the swing plate is rotatably mounted on the input drive shaft by having associated relation with the said bearing unit, and additionally including a third timing sprocket in fixed relation on the press drive shaft and having operative contact with the first timing belt, and a fourth timing sprocket in fixed relation on the input drive shaft and having operative contact with the second timing belt.

5. A flexible belt drive for an intermittently driven feed roll as defined by claim 1, wherein the gear and cam housing is vertically adjustable on the press for obtaining the desired feed line height, and additionally including a journalling plate fixed in spaced relation to the swing plate, aligned bearing units in the swing plate and in the journalling plate for journalling the stud shaft for rotation, and wherein one of the timing sprockets is located between the swing plate and the journalling plate, and the other timing sprocket is located on the extending end of the stud shaft beyond the journalling plate.

6. A flexible belt drive for an intermittently driven feed roll as defined by claim 5, additionally including an idler roller support having an adjustably fixed relation on the journally plate, an idler roller supported by the said roller support and said roller having a position for contacting the outside surface of the second timing belt for taking up slack in the belt.

7. In press feeding mechanism for feeding strip material, in combination with the crank drive shaft of the press, of a gear and cam housing fixed in a desired vertical position on the press and providing an intermittently driven feed roll, an input drive shaft for the gear and cam housing for driving the feed roll and having an end projecting from a wall of the housing, a bearing unit for journalling the input drive shaft in said wall and including a circular hub portion mounted concentrically on the projecting part of the drive shaft and being secured to the said housing wall, a swing plate mounted on the hub portion for rotative adjusting movement with respect to the input drive shaft as an axis, said swing plate having a releasably fixed connnection to the gear and cam housing for any rotatably adjusted position, a stud shaft supported by the swing plate and being journalled thereby for rotation, a pair of timing sprockets keyed to the stud shaft in side by side relation so as to rotate therewith, a first timing belt operatively connecting the press crank shaft with one of said timing sprockets, and a second timing belt operatively connecting the other timing sprocket with the input drive shaft.

8. Press feeding mechanism for feeding strip material as defined by claim 7, additionally including a journalling plate fixed in spaced relation to the swing plate, aligned bearing units in the swing plate and in the journalling plate for journalling the stud shaft for rotation, and wherein one of the timing sprockets is located between the swing plate and the journalling plate, and the other timing sprocket is located on the extending end of the stud shaft beyond the journalling plate.

9. In press feeding mechanism for feeding strip material, in combination with the crank drive shaft of a press, of a gear and cam housing having an adjustable securement to a wall of the press in associated relation to the crank drive shaft, said gear and cam housing journalling a feed roll and having an input drive shaft for driving the feed roll, a circular hub portion on the input drive shaft providing journalling means therefor and being secured to a wall of the gear and cam housing, a swing plate mounted on the hub portion for limited rotative movement around the input drive shaft as an axis, said swing plate having a releasably fixed connection to the gear and cam housing for any rotatably adjusted position of the plate, a stud shaft carried by and mounted on the swing plate for rotation, a pair of timing sprockets in spaced side by side fixed position on the stud shaft, and a flexible belt drive from the crank drive shaft to the input drive shaft, said drive including an elbow arrangement formed by the swing plate and by a first timing belt operatively connecting the press crank shaft with one of the timing sprockets, and by a second timing belt operatively connecting the other timing sprocket with the input drive shaft.

10. Press feeding mechanism for feeding strip material as defined by claim 9, additionally including a ring bushing in the mounting of the swing plate on the hub portion, and an oil tube carried by the swing plate for maintaining the ring bushing and associated parts in a lubricated condition.

* * * * *